United States Patent [19]

Meier

[11] 4,201,286

[45] May 6, 1980

[54] APPARATUS FOR THE INDIVIDUAL CONVEYING OF PRINTED PRODUCTS ARRIVING IN AN IMBRICATED PRODUCT STREAM

[75] Inventor: Jacques Meier, Gossau, Switzerland

[73] Assignee: Ferag AG, Hinwil, Switzerland

[21] Appl. No.: 908,538

[22] Filed: May 22, 1978

[30] Foreign Application Priority Data

Jun. 6, 1977 [CH] Switzerland ..... 6921/77

[51] Int. Cl.[2] ..... B65H 29/04

[52] U.S. Cl. ..... 198/461; 198/650; 271/202; 271/206; 271/277

[58] Field of Search ..... 271/7, 199, 202, 204, 271/206, 265, 270, 271, 277; 198/459, 461, 462, 650

[56] References Cited

U.S. PATENT DOCUMENTS

| | | | |
|---|---|---|---|
| 3,719,267 | 3/1973 | Reist et al. | 271/202 X |
| 3,955,667 | 5/1976 | Müller | 271/204 X |
| 4,007,824 | 2/1977 | Reist | 198/462 |
| 4,039,182 | 8/1977 | Reist et al. | 271/204 X |
| 4,072,228 | 2/1978 | Honegger et al. | 271/202 X |

FOREIGN PATENT DOCUMENTS

| | | | |
|---|---|---|---|
| 574364 | 4/1976 | Switzerland | 271/204 |

*Primary Examiner*—Robert W. Saifer
*Attorney, Agent, or Firm*—Werner W. Kleeman

[57] ABSTRACT

An apparatus for individually conveying printed products arriving in an imbricated product stream, comprising a number of driven controlled grippers revolving and guided in a closed path of travel for engaging the leading edge of the printed products. The gripper drive contains means for temporarily restraining the grippers. The gripper drive has at least one continuously driven sluice for the cycled recall of the restrained or stopped grippers. Operatively associated with the sluice is an endless revolving conveyor element equipped with entrainment members engaging the trailing edge of the products, the entrainment members being provided at a uniform spacing at the conveyor element. The conveyor element, as concerns the entrainment members, is driven in cycle with the sluice and opposite in sense to the sense of rotation or revolution of the grippers. There is also provided an infeed device having a drive operatively coupled with the drive of the sluice by a synchronous control.

10 Claims, 10 Drawing Figures

APPARATUS FOR THE INDIVIDUAL CONVEYING OF PRINTED PRODUCTS ARRIVING IN AN IMBRICATED PRODUCT STREAM

BACKGROUND OF THE INVENTION

The present invention broadly relates to material handling apparatus, and, more specifically, concerns a new and improved construction of apparatus for the individual conveying of printed products or the like arriving in an imbricated product stream.

The apparatus of the present invention is of the type comprising a number of driven, controlled grippers which revolve and are guided in a closed path of travel, these grippers serving to seize or engage the leading edge of the printed products, and the gripper drive is equipped with means for the temporary restraint or stoppage of the grippers.

An apparatus of this type has already been disclosed in Swiss Pat. No. 382,768. In that prior art system the grippers are stopped by a blocking lock or equivalent structure and released thereby as soon as the leading edge of a printed product has arrived at the mouth of the gripper. The grippers which are waiting in a preparatory position are retrieved by the printed products themselves, so that for the sequence of the grippers there is decisive the inner order or disorder of the imbricated product stream.

SUMMARY OF THE INVENTION

In contrast thereto, it is a primary object of the present invention to not only individually convey the printed products, but also to convey such with a certain regularity or uniformity, i.e., in cycle.

In keeping with the immediately preceding object it is still a further object to thereby, among other things, render possible infeeding the imbricated product array to a machine where the printed products can be individually processed. Such machine can be, for instance, a stuffing machine where there are assembled together or united the main product or section and a number of auxiliary products or sections.

Yet a further significant object of the present invention aims at the provision of a new and improved construction of apparatus for individually conveying printed products arriving in an imbricated product stream in an extremely reliable, accurate and uniform manner, which apparatus is relatively simple in construction and design, quite economical to manufacture, extremely reliable in operation, not readily subject to breakdown or malfunction, and requires a minimum of maintenance and servicing.

Now in order to implement these and still further objects of the invention, which will become more readily apparent as the description proceeds, the apparatus of the present development is manifested by the features that the gripper drive is provided with at least one continuously driven sluice for the cycled recall of the restrained or stopped grippers. This is operatively associated with the sluice an endless revolving conveyor element which is equipped at a substantially uniform spacing from one another with entrainment members engaging with the trailing edges of the printed products. The conveyor element is driven as concerns the entrainment members in cycle with the sluice and in opposite sense in relation to the sense of revolving motion of the grippers. Further, there is provided an infeed device having a drive which is coupled by a synchronous control with the drive of the sluice.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
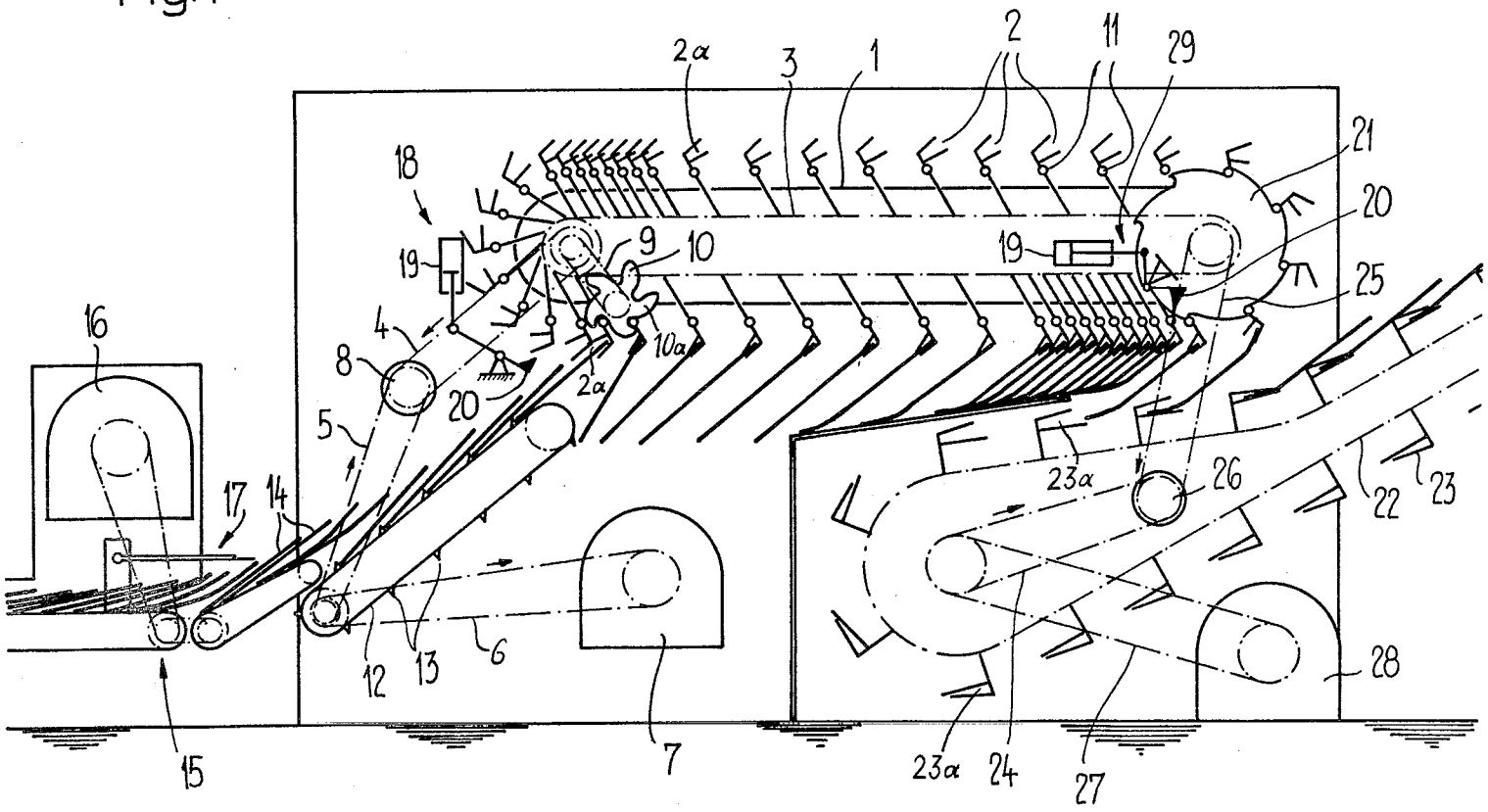
FIG. 1 is a markedly simplified schematic side view of apparatus for individually conveying printed products or the like arriving in an imbricated product stream and incorporating two sluices or gates.

Describing now the drawings, based upon the showing of FIG. 1 there will be considered the basic construction of the apparatus and its mode of operation as contemplated by the invention and serving for individually conveying articles, typically printed products arriving in an imbricated product stream or array. In the description to follow these basic principles of the invention will be considered, and the details will then be explained based upon the remaining Figures of the drawings.

As will be apparent from the showing of FIG. 1, there is provided as the revolving path of travel a track or rail 1 in which there are guided the grippers 2. The gripper drive will be seen to comprise a revolving entrainment chain 3 which is force-lockingly or frictionally entrainably connected with the grippers 2. The entrainment chain 3 is driven by a drive motor 7 through the intermediary of the drive chains 4, 5 and 6. Between the drive chains 4 and 5 there is arranged a differential gearing or transmition 8, which, as indicated by the arrows, on the one hand, constitutes a reversing gearing or drive, and, on the other hand, by adjusting its normally fixed or stationary transmission element causes a relative movement between the chains 4 and 5. In order to better understand this point, it is here remarked that there can be used as the differential gearing a differential transmission or gearing as the same is used in automobile or roadway vehicles, and the chains 4 and 5 can be connected with one of the two sun wheels or gears provided for the power take-off shafts and the planetary support would then be connected via an adjustment device with the machine frame. The drive chain 4 is in drive connection by means of a further drive chain 9 with a star-like, rotatably mounted sluice or gate 10. This rotatable sluice or gate 10 engages by means of its radial arms 10*a* in a gear-tooth like fashion between the entrainment elements or cams 11 of the grippers 2 arranged in a row in the direction of revolution in front of the sluice or gate 10, here assumed to be revolving in the counterclockwise sense or direction. As wil be apparent, the grippers 2 are temporarily restrained or stopped by the sluice or gate 10 and thereafter are released at a cycle determined by the revolving motion of the sluice for entrainment by the chain 3. During this drive by means of the sluice 10 the grippers 2 which were previously opened are then closed.

By means of the drive chain 6 there is revolvingly driven an endless conveyor element or member 12 which is equipped at a substantially uniform spacing with one another with the entrainment members 13. These entrainment members 13 are intended for engaging with the trailing edges of the printed products 14 which are infed by means of an infeed device 15 composed of conveyor bands or belts or equivalent structure. The infeed device 15 is driven by a drive motor 16. The arrangement is carried out such that, on the one hand, the mutual spacing of the entrainment members 13 is greater than the mutual spacing of the printed products in the imbricated product stream (the spacing of the imbricated products from one another) and, on the other hand, the velocity of the conveyor element 12 exceeds that of the infeed device or infeed means 15. This has the result that the entrainment members 13 pull apart the printed products 14, so that there is formed a so-to-speak thinned-out imbricated stream having uniform product spacing. Accordingly, and for purposes of explanation, there will be referred hereinafter to the conveyor element 12 equipped with the entrainment members 13 as a pre-cycler. This pre-cycler, as apparent from the showing of the drawings, is coupled with the sluice 10 in such a manner that the printed products are engaged by means of the leading edge each time in the still open mouth 2*a* of a gripper 2 which has just been fed by the sluice 10, and each such related printed product is then engaged and further conveyed by such gripper 2. With the aid of the differential gearing 8 the sluice 10 and the pre-cycler can be adjusted with regard to their relative position to accommodate the momentary format or shape of the printed products being handled. The drive motor 16 of the infeed device 15 is connected with the drive motor 7 of the sluice 10 by means of a synchronous control which is not shown in FIG. 1 but will be discussed more fully hereinafter in conjunction with FIG. 10, this synchronous control ensuring that for each arriving printed product 14 there is available one of the entrainment members 13. The synchronous control is equipped with a phase correction device or phase corrector which has a position signal transmitter actuated by the leading edges of the printed products. Owing to these measures the entrainment members 13, even if there is an irregular configuration of the spacing between the imbricated products, come into play in a phase-proper position. Irregularities in the imbricated product stream caused by missing product copies are detected at the region of the pre-cycler by means of a detector which has not been shown in this FIG. 1, and which actuates an infeed blocking device or locking means 18. This infeed blocking device 18 has a blocking lock or blocking member 20 which can be actuated by a displaceable or shiftable element 19, so that the gripper which is correlated to the missing product copy, is held back by one cycle. Due to these measures grippers which are empty cannot be engaged by the sluice 10 and further conveyed.

Along the course of travel of the revolving grippers 2 there is provided a second sluice or gate 21. This second sluice 21 is constructed and functions in the manner of the first sluice or gate 10. Accordingly, the grippers 2 during the course of their revolving motion also are temporarily restrained or stopped by the sluice 21, and thereafter, are further conveyed in a certain cycle or rhythm by such sluice 21, and at the same time the grippers 2 are opened and the printed products which previously up to this time were entrainably moved along are then released. Also the sluice 21 has operatively associated therewith an endless conveyor element or member 22 which is equipped with controlled entrainment members 23 arranged at a uniform spacing from one another and is in drive connection with the sluice 21 by means of drive chains 24 and 25 or equivalent structure as well as by means of a differential gearing or transmission 26 arranged between such drive chains 24 and 25. The drive chain 26 is connected by means of a further chain 27 with a drive motor 28. By virtue of the previously described drive connection the grippers 2, on the one hand, and the controlled entrainment members 23, on the other hand, are driven in the same cycle or rhythm, however in the opposite rotational sense or direction, so that the trailing edges of the printed products always arrive into the open mouth 23*a* of an entrainment member 23. As soon as this has been accomplished the grippers 2 are opened and the printed products are transported away in the cycle or rhythm which is forced thereon by means of the entrainment members 23. Accordingly, for the sake of clarity in understanding of the invention, the conveyor element 22 which is equipped with the entrainment members 23 will be referred to hereinafter as the cycle transport device or cycle transport means. The transfer of the product copies at the cycle transport device can be temporarily interrupted by means of an outfeed blocking device 29 which, like the infeed blocking device 18 has a displaceable or displacement element 19 and a blocking lock 20. This outfeed blocking device 29 can be actuated by a monitoring device which has not been particularly shown in this FIG. 1, and which monitors the number of grippers 23 waiting in front of the sluice 21 and responds when the gripper supply falls below a minimum threshold, for instance two grippers. In this way there can be avoided disturbances during the transfer of the grippers by the sluice 21. Furthermore, the outfeed blocking device 29 is actuated by a detector, likewise not shown in this FIG. 1, which responds to disturbances in the working zone or region merging with the cycle transport device. In this working zone there can be arranged manifold devices to which there are infed the printed products. In most instances, there would be provided a stuffing machine, for instance a stuffing drum by way of example. This stuffing drum or another suitable processing machine operates in the same cycle as the sluice 21 and the cycle transport device, and in the simplest case the sluice and cycle transport device are operatively connected with the drive of the processing machine. By virtue of the already mentioned synchronous control this drive is coupled with the drive motor 16, i.e. with the drive of the infeed device, and specifically such that the last-mentioned drive of the infeed device is influenced by the first-mentioned drive. Stated in another way: the supply of printed products available at the infeed device is accommodated to the demand of the processing machine, wherein, as already explained heretofore, the pre-cycler 12–13 and first sluice 10 assume the supply of the infeed device in all cases and phase-proper. The foregoing observations will be best understood by referring to FIG. 10 wherein the same components have generally designated by the same reference characters.

Figure 10:
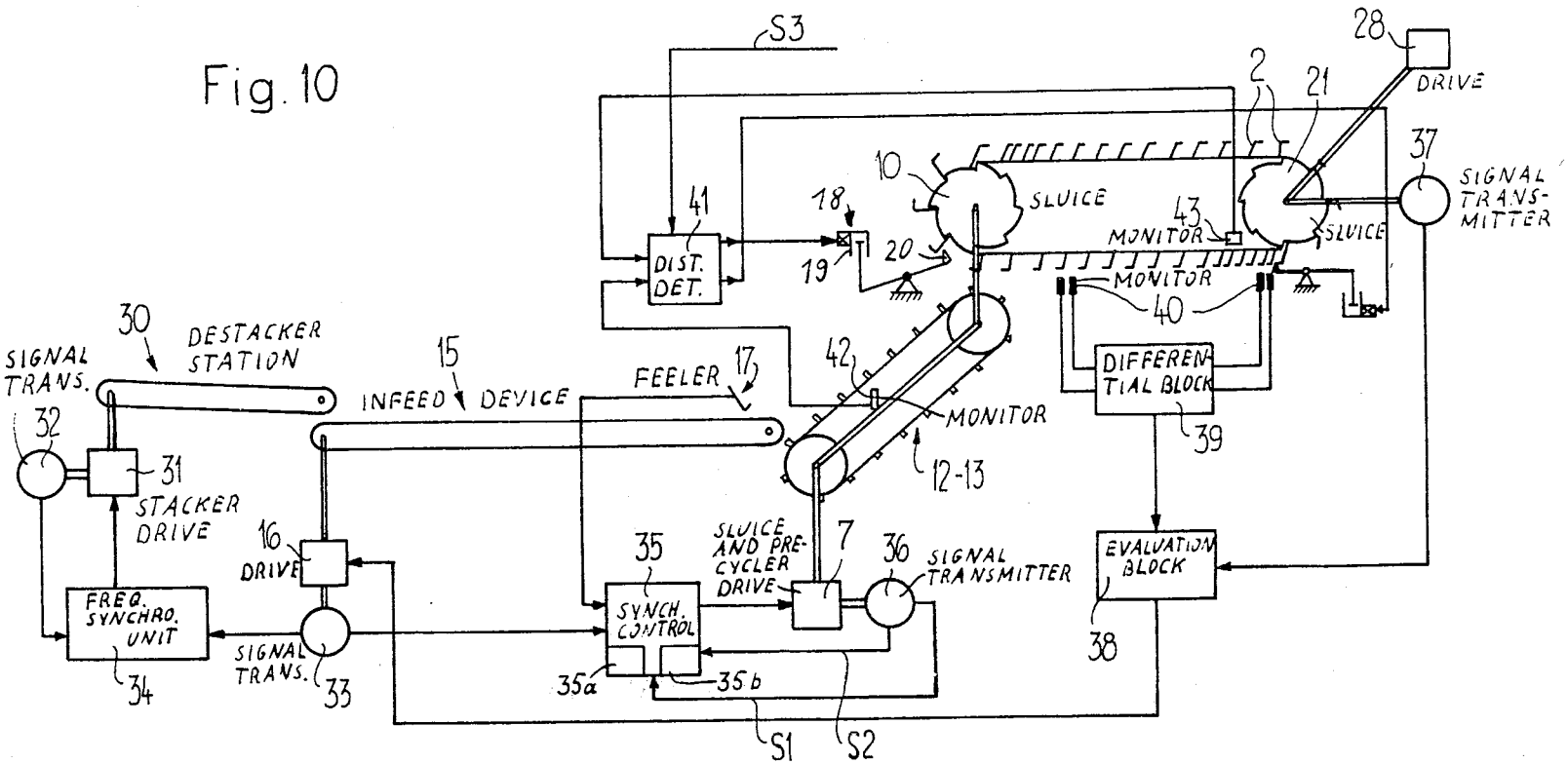
FIG. 10 schematically illustrates the synchronous control.

Turning attention now to FIG. 10, it is to be assumed that with reference thereto the imbricated product stream of printed products 14 has been formed by separating individual product copies of a stack at a destacker station 30 and thereafter arrives from station 30 at the infeed device 15. The drive 31 of the destacker station 30 and the drive 16 of the infeed device 15 each have a therewith rotating signal transmitter 32 and 33, respectively, which is connected with the frequency synchronous unit 34 of the synchronous control. The latter influences the drive 31 of the destacking station 30 in such a manner that the momentary reception capacity of the infeed device 15 is satisfied by the destacking station 30.

The signal transmitter 33 of the drive or drive means 16 of the infeed device 15 is furthermore connected with the main unit or block 15 of the synchronous control, which apart from having a further frequency synchronization component also contains the phase corrector. The main block or unit 35 is supplied with signals of a further signal transmitter 36 which is coupled with the drive or drive means 7 of the pre-cycler 12–13 and the sluice 10. The signal transmitter 36 delivers two different types of signals, namely signals S1 and S2, wherein the signals S1 indicate the momentary drive velocity and the signals S2 the phase of the entrainment members 13 of the pre-cycler 12–13. The main block or unit 35 is furthermore also supplied with the signals of the feeler or scanner 17 arranged at the region of the outfeed end of the infeed device 15. Based upon these signals the main block 35 then—as indicated in the drawing of FIG. 10—controls the drive 7 of the pre-cycler 12–13.

Considering the arrangement of the invention in greater detail the same can be accomplished in the following manner: based upon the signals of the signal transmitter 33 the synchronous control determines a coarse reference value which is infed to the drive or drive means 7. At the same time the signals of the signal transmitter 33 and the signals $S_1$ of the signal transmitter 36 arrive at a forwards-backwards or up-down counter **35*a* which adds the signals of the transmitter 33 and subtracts the signals of the transmitter 36. Based upon the counting result the coarse reference value is continuously accommodated, so that the drives or drive means 7 and 16 run in absolute synchronism. This frequency-synchronized operation however is not yet completely sufficient. What is even more so required is that the entrainment members 13 travel phase-correct with regard to the product copies arriving from the infeed device 15 at the pre-cycler 12–13. The phase correction is accomplished by means of the signals $S_2$. It would be possible to imagine, for instance, that the signal transmitter 36 per revolution transmits 100 pulses in order to form the signals $S_1$ and additionally for each revolution delivers a further pulse for forming the signals $S_2$, wherein, as already mentioned, the last-mentioned pulse is intended to indicate the momentary entrainment phase. The signals $S_1$ are now counted in a counter 35*b* which is always reset to null by means of the signals $S_2$, this counter always again counting from null to 99. Upon infeed of the signals of the feeler or scanner 17 there is then detected the counter state of such counter. If the counter for instance is between 40 and 60 then with regard to the sampled copies the correlated entrainment members are in the correct phase and within the permissible tolerance. If, however, the counter is below 40, this then means that the relevant entrainment member has been shifted back too far in relation to the product copy. In this case there is then so-to-speak charged into the previously mentioned forwards-backwards counter 35*a* the value +10 and according to the "overcharging" of such counter the coarse reference value is then immediately modified, so that pre-cycler 12–13 is momentarily accelerated and the entrainment member overtakes with respect to the product copy. The pre-cycler 12–13 then travels more quickly for such length of time until the infed value +10 has again been counted-out of the forwards-backwards counter 35*a*. If conversely the counter state in the other counter 35*b* exceeds the value 60, when the signal of the feeler 17 arrives, this then means that in analogous manner the entrainment member 13 correlated to the just sampled product copy is disposed too far forwardly. In this case there is charged into the forwards-backwards counter 35*a* the value −10 and analogous to what has already been described before then the pre-cycler 12–13 is braked for a certain amount of time. Since the product copies must be sampled or scanned prior to their transfer or take-over by the entrainment members 13**, in order to be able to accomplish any necessary correction, the displacement path-difference is bridged by means of a shift register. These measures are of significance in the first instance at the start of a cycle, since any possibly random difference between the phase of the printed products and that of the entrainment members already is compensated after a number of cycles. In the so-called built-up or non-transient state the phase correction device need only respond in exceptional instances, for instance then when a printed product has been shifted in relation to its normal position. In any event the control only responds to such an extent to this error as is needed for the next correct situated product copy to still be engaged or seized.

Also the drive or drive means 28 is coupled with a signal transmitter 37. The related signals are evaluated in a further unit or block 38 of the synchronization control and infed to the drive or drive means 16, which thereby is controlled in accordance with the momentary conveying load or output of the cycle transport device and the processing machine arranged thereafter i.e. downstream thereof. Basically, the infeed device 15 should satisfy the removal requirements. A correction can be accomplished, however, with the aid of a differential recognition unit or block 39 of the synchronization control which, by means of the monitored device or monitor means 40 monitors, within a measuring path, the number of grippers 2 which are available in front of the sluice 21. If the actual value of the grippers 2 within this measuring path does not coincide with the reference value or reference count, then by means of the differential recognition unit 39 there is delivered a signal to the unit 38 and the output signal of this unit 38 is altered such that the velocity of the drive means 16, and thus, also that of the drive or drive means 7 is increased or reduced until the number of grippers 2 within the measuring or measurement path has again reached the reference or set value.

From the showing of FIG. 1 there will be furthermore apparent that for the infeed blocking device 18 and the outfeed blocking device 29 there is provided a further block or unit 41. There are infed into the unit 41 the signals S3 which indicate a disturbance at the processing machine. Further inputs of the block or unit 41 are connected with a monitor device or monitor means 42 arranged at the region of the pre-cycler 12–13 as well as at a monitor means 43 mounted forwardly of the sluice 21, so that by means of the first monitor device 42 there can be activated the infeed blocking device 18 and by means of the second monitoring device 43 the outfeed blocking device 29.

Figure 4:
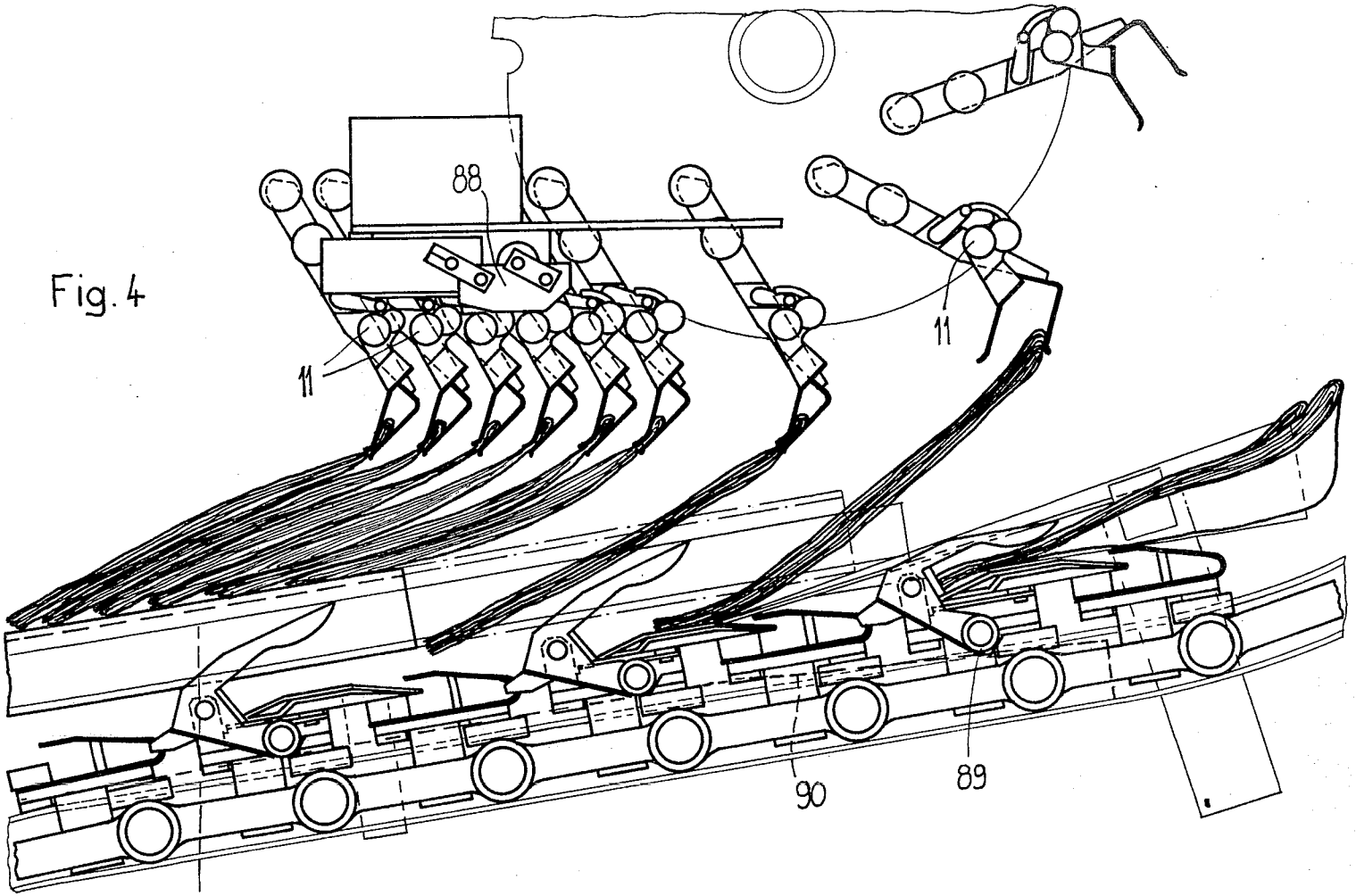
FIG. 4 is an enlarged view of a section or detail of the arrangement of FIG. 1 at the region of the second sluice.
Figure 5:
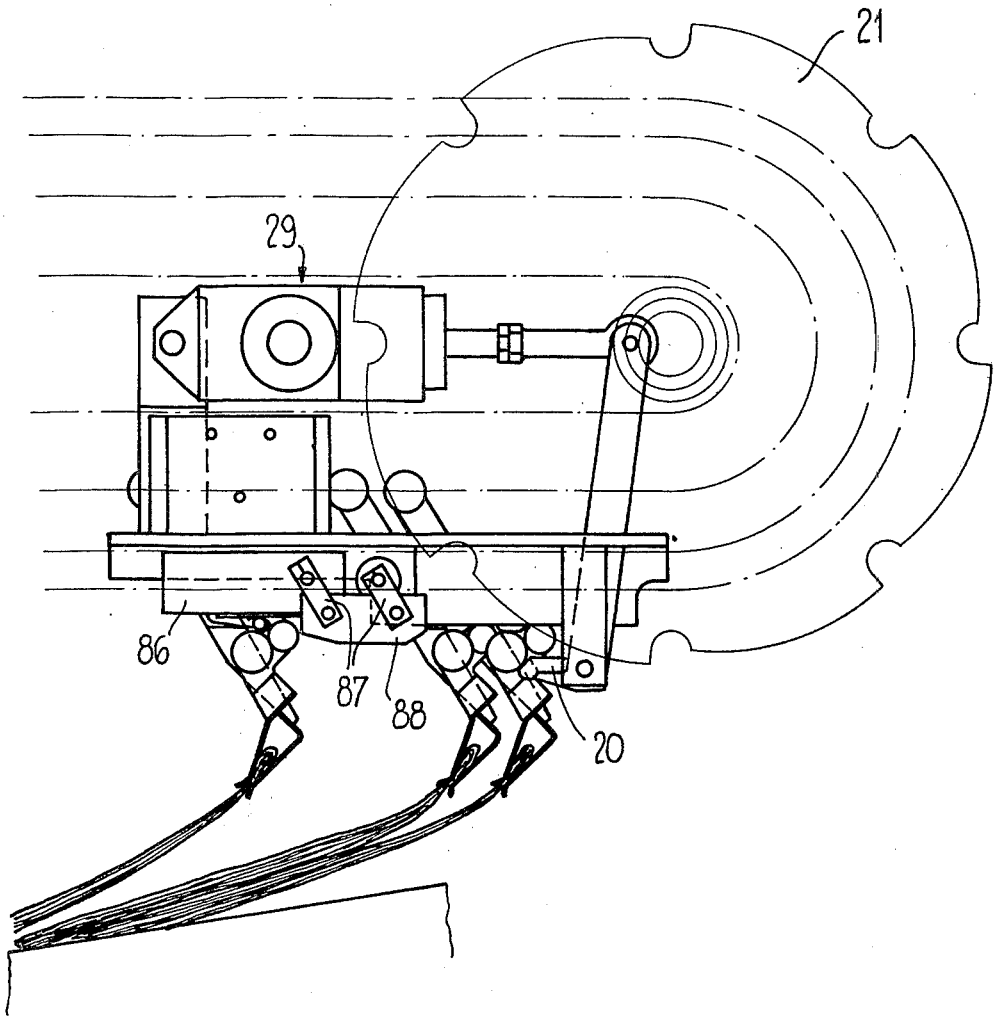
FIG. 5 illustrates at least part of the structure of FIG. 4 in a different operating position.
Figure 7:
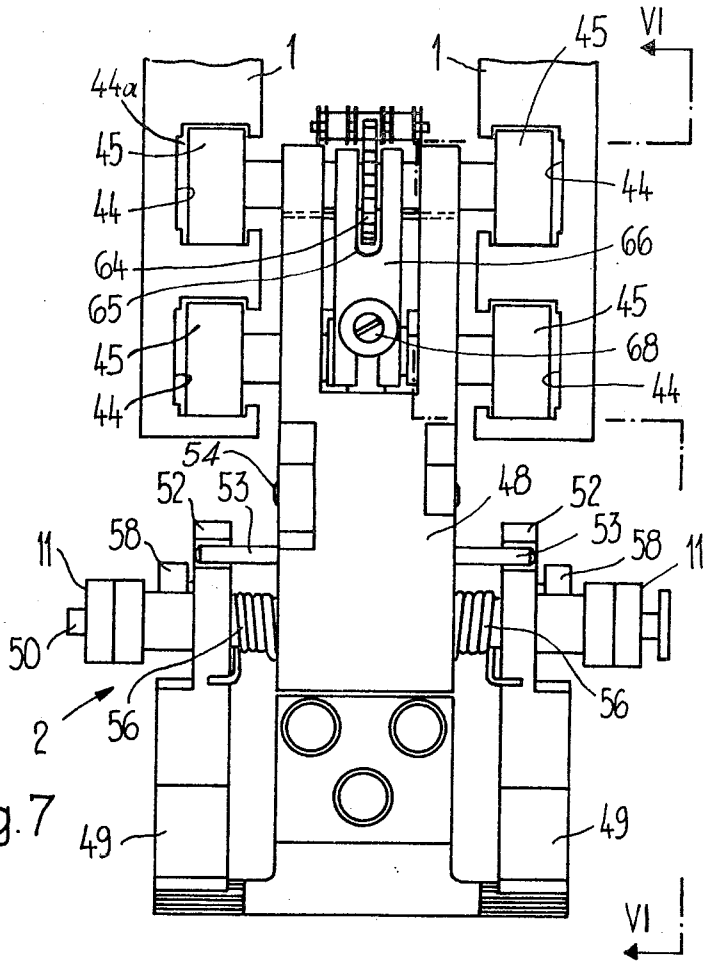
FIG. 7 is a front view of the gripper shown in FIG. 6.
Figure 6:
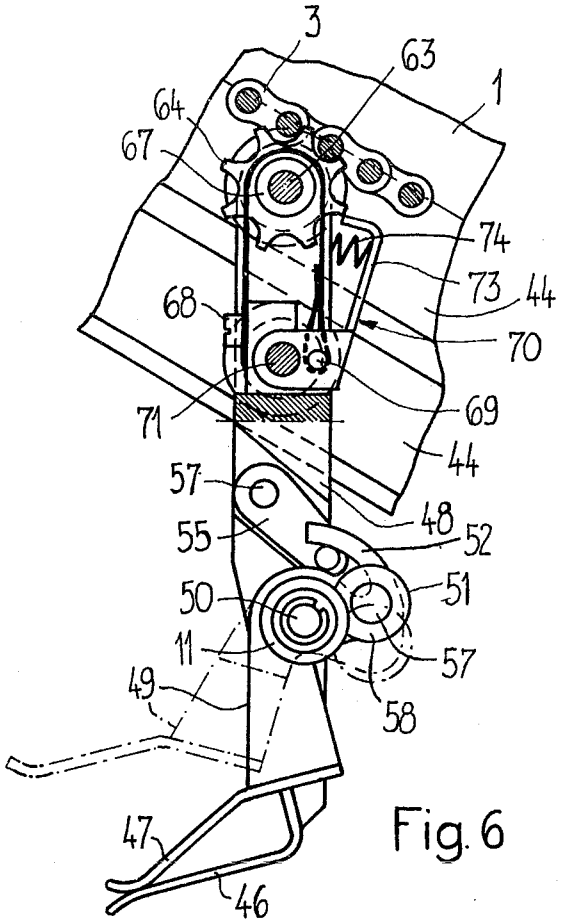
FIG. 6 is an enlarged view of the construction of a gripper viewed from the side and partially shown in sectional view, taken substantially along the line VI—VI of FIG. 7.

Further notable details regarding the construction of the apparatus can be seen by referring to FIGS. 2 to 9 inclusive. In this respect it is to be appreciated that FIGS. 6 and 7 show the construction of the grippers and their arrangement at the guide rail. There will be recognized that the guide rail 1 has two superimposed pairs of guide grooves 44 confronting one another at their slots **44*a* and in which there are guided the grippers 2 by means of two pairs of guide wheels or rolls 45. The axial spacing of the roller or roll pairs 45 is greater than that of the guide grooves 44, so that the grippers which are of substantially L-shaped configuration as viewed from the side, can assume an inclined position (cf. also FIG. 1). By virtue of this arrangement the spacing from gripper mouth to gripper mouth is minimum, when the grippers for instance waitingly gear against one another at one sluice and at the cycle wheel of the sluice, respectively, (cf. FIG. 1). The gripper mouth with an open gripper is formed by a fixed clamping tongue 46 and a movable clamping tongue 47 which are mounted at a shaft 48. Specifically, the first-mentioned clamping tongue 46 is fixedly mounted and the last-mentioned clamping tongue 47 is mounted by means of a pivotal or pivotable arm 49. The continuous pivot axis 50 of the pivotal arm 49 carries at its two ends the entrainment cams 11 which are engaged by the clock wheels of the sluice 10 and 21**, respectively, and are constructed as ball bearings for the purpose of reducing friction and wear.

Figure 9:
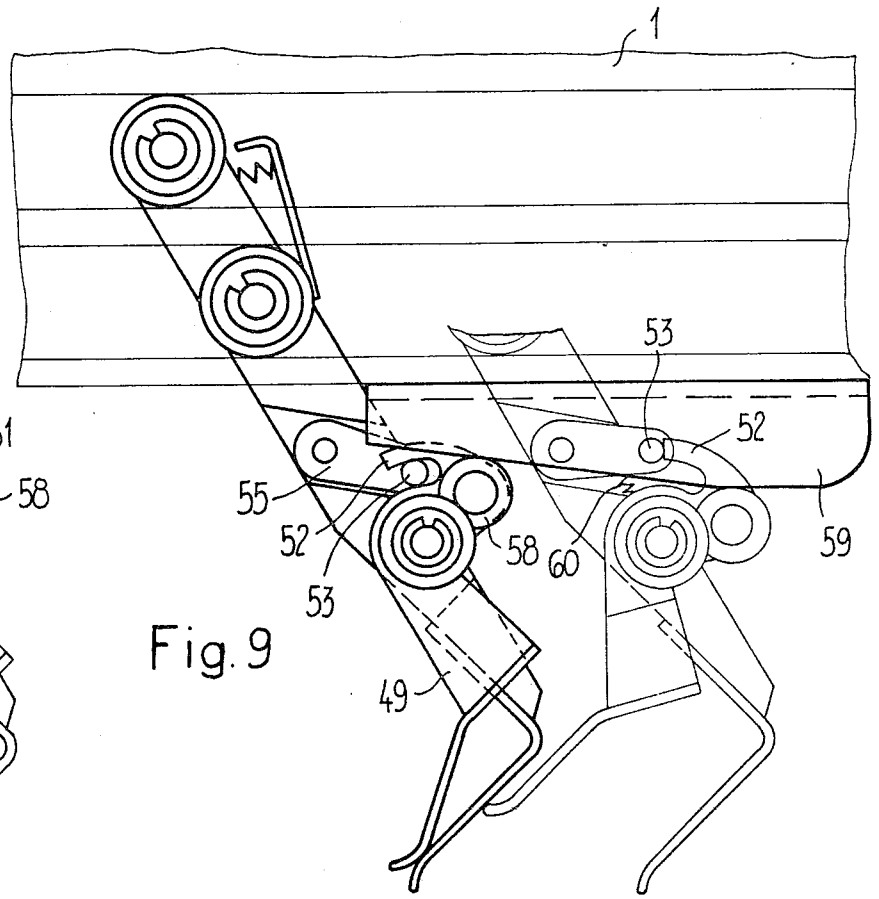
FIG. 9 illustrates a gripper at the region of an opening curve or cam arranged along the course of the revolving path of travel of the grippers.
Figure 8:
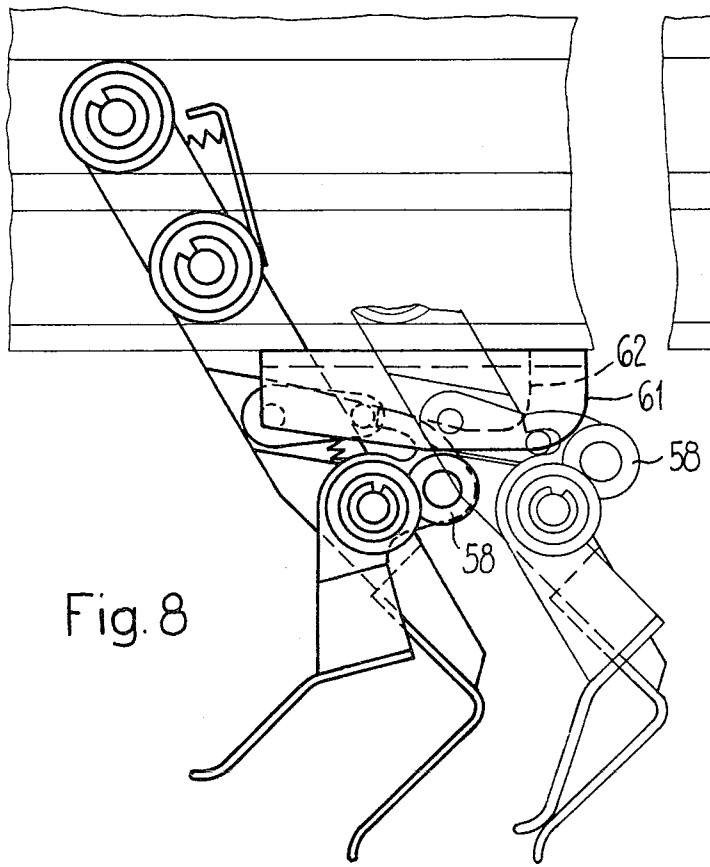
FIG. 8 is a gripper at the region of closing curves or cams arranged along the course of the revolving path of travel of the grippers.

As best seen by referring to FIG. 7, the pivotal arm 49 engages in a fork-like manner the shaft 48 and it will be seen to have at each of its flanges a laterally protruding eyelet 51 as well as a stop 52 which coacts with a counter stop or impact member 53. The pin-shaped counter stops 53 are mounted in each case at a blocking pawl 55 hingedly connected at location 54 at the related shaft 48. These blocking pawls 55 are spring-loaded, so that the counter stops 53, with open gripper, engage behind the stops 52 (cf. the phantom-line portion of FIG. 6 or, for instance, FIG. 2). If the counter stops 53 are rendered ineffectual, then the gripper is closed with the aid of the closure spring 56 (FIG. 7), and the stops 52 engage over the counter stops 53 (FIG. 6). In the eyelets 51 there are formed axial journals 57 (see FIG. 6) which carry rolls or rollers 58—these rolls 58 in FIG. 6 cover the eyelets 51—which serve for gripper actuation. In this connection there is already made reference to FIGS. 8 and 9. These FIGS. 8 and 9 show the opening of a gripper with the aid of opening cams or curves 59 arranged laterally of the rail 1 and which engage at the rolls 58 and rock the pivotal arm 49 in its open position shown in thin lines in FIG. 9. Consequently, the stops 52 of each pivotal arm 49 free the counter stops 53, which under the action of the springs 60 acting upon the pawls 55 engage behind the stops 52. For closing a gripper which has already been opened in this manner there are utilized the closure cams or curves 61 and 62 shown in FIG. 8. The closure cam 61 engages at the rolls 58, in order to relieve the stops 52 and the counter stops 53, respectively, so that the latter also can be rendered ineffectual by the control cams 62 which engages thereat. If then, as shown at the right of FIG. 8, the rolls 58 are released by the control cams 61, then the stops 52 engage over the counter stops in their ineffectual position.

Reverting to FIGS. 6 and 7 it will be seen that the shaft or axle 63 of the upper guide wheel pair (wheel 45) freely rotatably carries a sprocket wheel or gear 64 which engages with the entrainment chain 3. The sprocket wheel 64 is located in a slot 65 of a braking band 66 having a U-shaped flexed configuration and trained about the hub 67 of the sprocket wheel 64. The one end of the braking band 66 is anchored by means of a screw 68 or equivalent fastening means at the shaft 48 of the gripper, the other end is anchored at location 69 at an angle-shaped braking lever 70 which is hingedly connected or articulated at the shaft 71 of the lower traveling wheel pair. At the actuation arm 73 of the braking lever 70, and which actuation arm faces towards the front in the direction of travel of the grippers, there engages a spring 74 or equivalent structure, which bears against the shaft 48. Consequently, the sprocket wheel is hindered in rotating by the brake or braking band 66, however not necessarily under all instances blocked. In accordance with the frictional connection between the braking band 66 and the sprocket wheel 64 the grippers 2 are entrained by the entrainment chain 3. As soon as, however, the grippers impact against one another, as such has been shown at the right-hand side of FIGS. 1 and 4 for instance, then in each case the actuation arm 73 of the successive gripper comes to bear against the end face of the shaft of the preceding gripper which acts as a stop for such subsequent gripper, so that the brake is vented and the sprocket wheel can freely rotate. If then the forwardmost gripper is entrained by the sluice 21 (or the sluice 10), then the brake of the immediately successive gripper and then that of the next following gripper and so forth will be pulled and the waiting grippers will move forwardly. The force-locking or frictional connection of the grippers with the entrainment chain is thus capable of being influenced, in order to maintain small the drive power requirements as well as also the wear.

Figure 2:
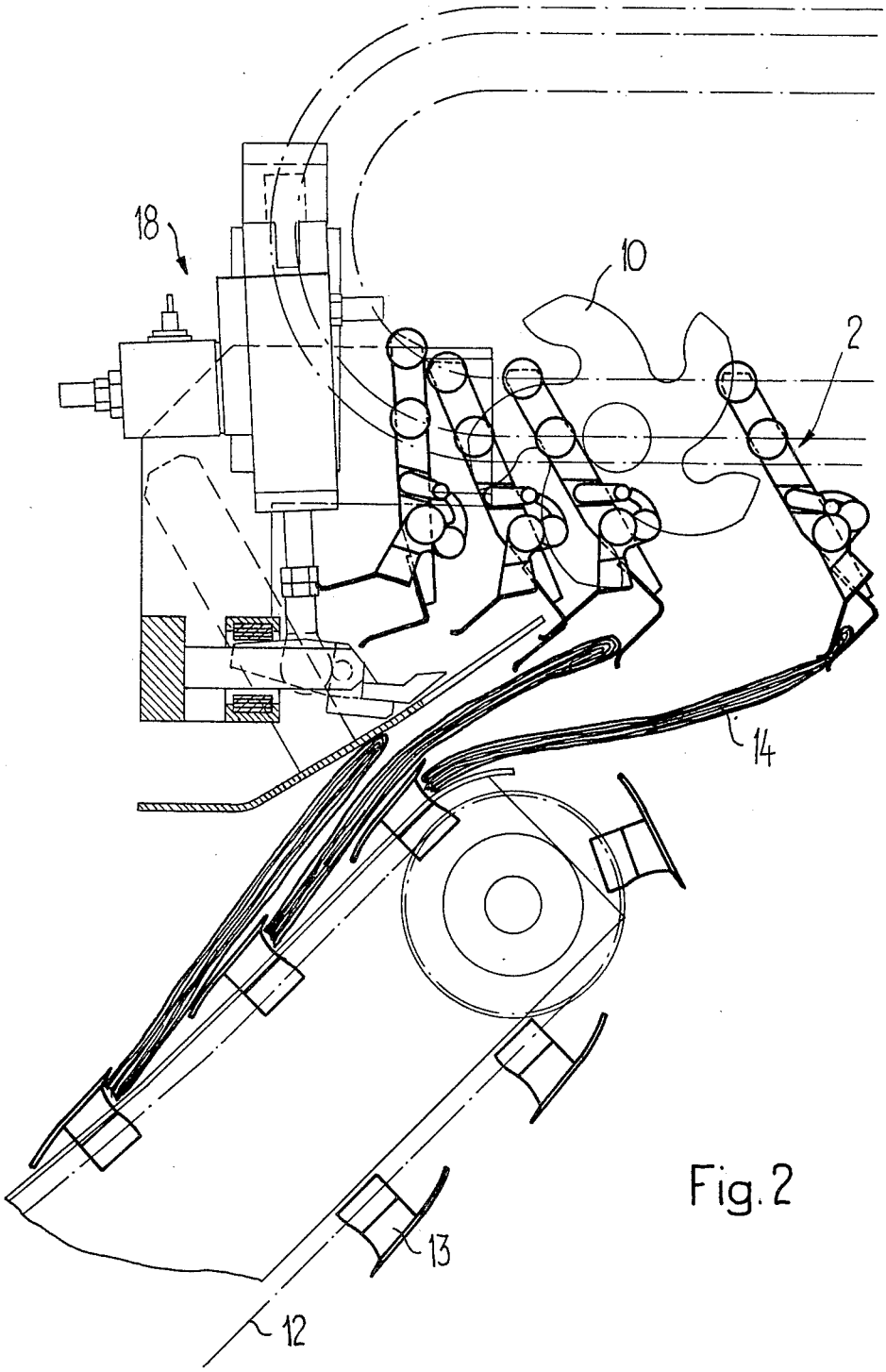
FIG. 2 is an enlarged view of a section or detail of the arrangement of FIG. 1 at the region of the first sluice or gate thereof.
Figure 3:
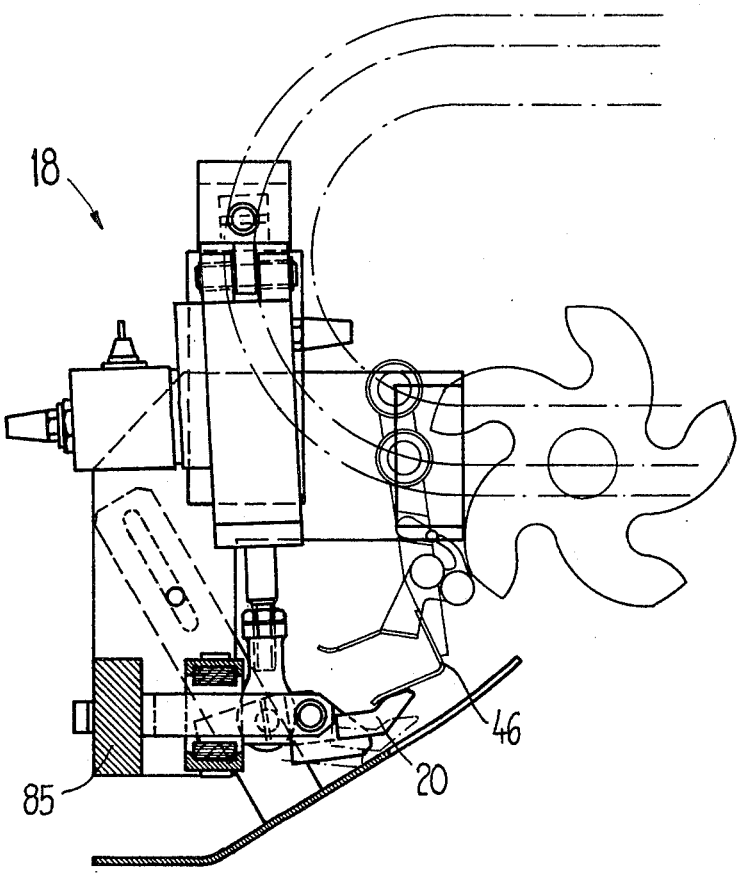
FIG. 3 is a view similar to the showing of FIG. 2 illustrating the structure thereof in a different operating position.

By referring to FIG. 2 there will be more clearly recognized details regarding the transfer or take-over of the printed products 14 by the grippers 2 and the mode of operation of the sluice 10. There will be especially well seen that the spacing between the open mouth **2*a* of a just charged or loaded gripper 2 and the next immediately following gripper 2 is minimum, so that the imbricated product formation can be received at a high speed or velocity. Contributing to this is also the fact that the sluice 10 continuously revolves or travels and that the grippers 2 before, during and after the take-over are gradually accelerated. This results in a continuous stream or flow of the grippers which practically only then come to standstill when the infeed blocking device is activated, as has been shown in FIG. 3. The blocking lock 20 engages then below the stationary clamping tongue 46 of the gripper to be stopped. The blocking pawl or lock 20 can be adjusted with the aid of a screw 85 or other equivalent structure. What has been said is analogously valid for the outflow or outfeed blocking device 29 (FIG. 5), the blocking pawl or lock 20 of which, for instance, then engages if there are only still two grippers located in front of the sluice 21. In this case, the engagement is triggered by a microswitch 86 which has an actuation skid or rail 88 which is mounted at the guides 87. As best seen by referring to FIG. 4, normally the actuation rail 88 bears against the entrainment cams 11 of the waiting third and fourth grippers in front of the sluice 21 (see FIG. 4). If these grippers are absent, then the actuation skid or rail 88 drops downwardly and the outfeed blocking device 29 is triggered. By means of a further incoming gripper, as shown in FIG. 5, the rail or skid 88** is again raised. The arrangement also can of course be carried out such that not a single one, rather two incoming grippers, cause a switching-off of the blocking devices.

Furthermore, in FIG. 4 there will be apparent that the cycle transport device has controlled entrainment members 23 which are actuated by rolls or rollers 89 bearing at a control cam 90.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for individually conveying printed products arriving in an imbricated product stream, comprising:

a number of driven controlled grippers;

means for revolvingly driving and guiding said number of given controlled grippers in a closed path of travel for engaging the leading edge of the printed products;

said means for driving said grippers containing means for temporarily restraining the movement of the grippers;

said gripper drive means having at least one continuously driven sluice for the cycled recall of the restrained grippers;

an endless revolving conveyor element equipped with entrainment members engaging the trailing edges of the products operatively associated with said sluice;

said entrainment members being provided at a substantially uniform spacing at the conveyor element;

means for driving the conveyor element in cycle as concerns the entrainment members thereof with the sluice and opposite in sense to the sense of revolving movement of the grippers;

an infeed device having a drive means;

said sluice having a drive means; and a synchronous control for operatively coupling the drive means of the infeed device with the drive means of the sluice.

2. The apparatus as defined in claim 1, wherein:

said infeed device serves for the infeed of the printed products;

feeler means for the printed products arriving at the infed device; and said synchronous control comprising a phase corrector means connected with feeler means.

3. The apparatus as defined in claim 2, wherein:

two of said sluices defining first and second sluices are arranged in spaced relationship from one another in the direction of revolving movement of the grippers;

drive means for said second sluice;

said synchronous control controlling said drive means of the first sluice as a function of the drive means for the infeed device and said drive means for said infeed device as a function of the drive means of the second sluice.

4. The apparatus as defined in claim 3, further including:

blocking means arranged upstream of each sluice;

said blocking means of one of the sluices comprising a gap detector arranged at the region of the conveyor element; and monitor means for controlling the blocking means of the other sluice.

5. The apparatus as defined in claim 4, wherein:

said monitor means is arranged upstream of the other sluice.

6. The apparatus as defined in claim 5, wherein:

said monitor means comprises a gripper monitor device.

7. The apparatus as defined in claim 5, wherein:

said monitor means comprises a function monitor device.

8. The apparatus as defined in claim 1, wherein:

said means for revolvingly driving said grippers comprises an endless revolving driven traction element with which there are frictionally connected the grippers.

9. The apparatus as defined in claim 8, wherein:

said traction element comprises a link chain;

a freely rotatably mounted sprocket wheel engaging with the chain at each gripper; and brake means engaging at said freely rotatably mounted sprocket wheel.

10. The apparatus as defined in claim 9, further including:

an actuation element for said brake means arranged forwardly at each gripper in the direction of revolving movement thereof; and stop means arranged behind each gripper in the direction of revolving movement thereof for the actuation element of the next successive gripper.

* * * * *